US008629409B2

(12) United States Patent
Kovtoun

(10) Patent No.: US 8,629,409 B2
(45) Date of Patent: Jan. 14, 2014

(54) ION INTERFACE DEVICE HAVING MULTIPLE CONFINEMENT CELLS AND METHODS OF USE THEREOF

(75) Inventor: Viatcheslav V. Kovtoun, Santa Clara, CA (US)

(73) Assignee: Thermo Finnigan LLC, San Jose, CA (US)

( * ) Notice: Subject to any disclaimer, the term of this patent is extended or adjusted under 35 U.S.C. 154(b) by 0 days.

(21) Appl. No.: 13/363,036

(22) Filed: Jan. 31, 2012

(65) Prior Publication Data

US 2012/0193526 A1 Aug. 2, 2012

Related U.S. Application Data

(60) Provisional application No. 61/438,043, filed on Jan. 31, 2011.

(51) Int. Cl.

| | |
|---|---|
| ***H01J 49/26*** | (2006.01) |
| ***H01J 49/40*** | (2006.01) |
| ***H01J 49/06*** | (2006.01) |
| ***H01J 49/00*** | (2006.01) |

(52) U.S. Cl.

CPC ..... *H01J 49/063* (2013.01); *H01J 49/062* (2013.01); *H01J 49/0031* (2013.01)

USPC ..... 250/425; 250/423 R; 250/426

(58) Field of Classification Search

CPC . H01J 49/005; H01J 49/0031; H01J 49/0027; H01J 49/062; H01J 49/063; H01J 49/26; H01J 49/4225; H01J 49/40; G01N 27/622

USPC ..... 250/423 R, 425, 426, 493.1

See application file for complete search history.

(56) References Cited

U.S. PATENT DOCUMENTS

| | | | | |
|---|---|---|---|---|
| 5,572,035 | A | 11/1996 | Franzen | |
| 6,483,109 | B1 | 11/2002 | Reinhold et al. | |
| 6,713,757 | B2 * | 3/2004 | Tanner et al. | 250/288 |
| 6,794,642 | B2 * | 9/2004 | Bateman et al. | 250/281 |
| 6,875,980 | B2 * | 4/2005 | Bateman et al. | 250/292 |

(Continued)

OTHER PUBLICATIONS

Schwarz, S., "RF ion carpets: The electric field, the effective potential, operational parameters and an analysis of stability," International Journal of Mass Spectrometry 299 (2011), pp. 71-77.

(Continued)

*Primary Examiner* — David A Vanore
(74) *Attorney, Agent, or Firm* — Charles B. Katz

(57) ABSTRACT

A device and associated methods of operations are disclosed for interfacing on ion trap to a mass analyzer, such as a TOF mass analyzer. The device includes a plurality of sequentially arranged confinement cells having fixed locations. A group of ions, e.g., ions within a relatively narrow window of mass-to-charge ratio, is received by the device from the ion trap, undergoes fragmentation, and is transported through the device from a first to final confinement cell by a series of transfers between adjacent cells. The ion group is confined in each cell for a prescribed cooling period. By providing a suitable aggregate ion confinement time and by enabling concurrent transport and cooling of successively ejected ion groups, the ions are cooled sufficiently to enable the acquisition of mass spectra at high resolution, without having to substantially delay the ejection of a subsequent group of ions from the ion trap until cooling of the previous group is completed.

24 Claims, 5 Drawing Sheets

(56) References Cited

U.S. PATENT DOCUMENTS

| | | | | |
|---|---|---|---|---|
| 6,987,264 | B1 * | 1/2006 | Whitehouse et al. | 250/292 |
| 7,019,289 | B2 * | 3/2006 | Wang | 250/290 |
| 7,034,292 | B1 * | 4/2006 | Whitehouse et al. | 250/289 |
| 7,049,584 | B1 * | 5/2006 | Whitehouse et al. | 250/288 |
| 7,071,464 | B2 * | 7/2006 | Reinhold | 250/282 |
| 7,157,698 | B2 * | 1/2007 | Makarov et al. | 250/281 |
| 7,582,864 | B2 * | 9/2009 | Verentchikov | 250/290 |
| 7,718,959 | B2 | 5/2010 | Franzen et al. | |
| 7,858,926 | B1 * | 12/2010 | Whitehouse et al. | 250/281 |
| 7,923,681 | B2 * | 4/2011 | Collings et al. | 250/282 |
| 8,101,910 | B2 * | 1/2012 | Loboda | 250/292 |
| 8,278,619 | B2 * | 10/2012 | Makarov et al. | 250/282 |
| 8,334,507 | B1 * | 12/2012 | Whitehouse et al. | 250/292 |

OTHER PUBLICATIONS

Bollen, G., ""Ion surfing" with radiofrequency carpets," International Journal of Mass Spectrometry 299 (2011), pp. 131-138.

* cited by examiner

ION INTERFACE DEVICE HAVING MULTIPLE CONFINEMENT CELLS AND METHODS OF USE THEREOF

CROSS-REFERENCE TO RELATED APPLICATION

This application claims the priority benefit under 35 U.S.C. §119(e) of U.S. Provisional Patent Application Ser. No. 61/438,043 by Viatcheslav V. Kovtoun for "Ion Interface Device Having Multiple Confinement Cells and Methods of Use Thereof", filed Jan. 31, 2011, the entire disclosure of which is incorporated by reference.

FIELD OF THE INVENTION

The present invention relates generally to mass spectrometry, and more particularly to a device for energetically cooling groups of ions ejected from an ion trap prior to mass analysis.

BACKGROUND OF THE INVENTION

Tandem mass spectrometry, referred to as MS/MS, is a popular and widely-used analytical technique whereby precursor ions derived from a sample are subjected to fragmentation under controlled conditions to produce product ions. The product ion spectra contain information that is useful for structural elucidation and for identification of sample components with high specificity. In a typical MS/MS experiment, a relatively small number of precursor ion species are selected for fragmentation, for example those ion species of greatest abundances or those having mass-to-charge ratios (m/z's) matching values in an inclusion list. There is growing interest in the use of "all-mass" MS/MS, in which all or a substantial subset of the precursor ions are fragmented. All-mass MS/MS yields information-rich spectra and removes the need to select and isolate particular ion species prior to mass analysis. In order to simplify the interpretation of product ion spectra produced by all-mass MS/MS, the analysis is conducted as a series of fragmentation/spectral acquisition cycles performed on different subsets or groups of the precursor ions, with each subset or group representing a different range of precursor ion m/z's. For example, if the precursor ions have m/z's ranging from 200 to 2000 Th, the first fragmentation/spectral acquisition cycle may be performed on a first group of ions having m/z's between 200 and 210 Th, the second fragmentation/acquisition cycle may be performed on a second group of ions having m/z's between 210 and 220 Th, and so on. U.S. Pat. No. 7,157,698 to Makarov et al., the disclosure of which is incorporated by reference, teaches a mass spectrometer architecture for implementing all-mass MS/MS with separation of the precursor ions into groups according to their m/z's. In the Makarov apparatus, an orthogonal-ejection two-dimensional ion trap is employed to eject m/z-grouped precursor ions into a collision cell, where the ions undergo fragmentation. The resultant product ions are transported to the entrance of a time-of-flight (TOF) mass analyzer for acquisition of a mass spectrum. TOF mass analyzers are particularly well-suited to all-mass MS/MS experiments due to their wide mass ranges and relatively short analysis times.

In the Makarov apparatus and similar designs employing an ion trap for mass-selective ejection, it is important to reduce the kinetic energy spread of the ejected ions, and product ions derived therefrom, prior to delivering the ions to the entrance of the mass analyzer. In TOF and other mass analyzers, high initial kinetic enlarge variations in the initial kinetic energies of the ions may significantly compromise measurement performance, particularly with respect to resolution and mass accuracy. Cooling of the ions to reduce kinetic energy and kinetic energy spread may be accomplished by directing the ions through a cooling region in which the ions lose energy via collisions with neutral gas molecules. Makarov uses an elongated collision cell structure with an axial DC gradient to provide the cooling region. The degree of energetic cooling will depend on the number of collisions experienced by the ions within the cooling region, which is governed by the product of residence time and cooling region pressure (t*P). For a cooling region held at a typical operating pressure, a total ion residence time of between 0.5-1.5 millisecond (ms) may be required to reduce ion kinetic energies to values that enable high-resolution mass analysis. This residence or cooling time may be substantially greater than the times required for ejection of an ion group from the trap (as well as for mass analysis of an ion group), which means that the ejection of a subsequent ion group from the trap into the fragmentation/cooling region must be delayed until cooling of the first ion group is completed. Differently expressed, the cooling period limits the rate at which the all-ion MS/MS analysis may be conducted and reduces the total number of analyses that may be performed during a chromatographic elution peak. Of course, the rate may be increased by employing a shorter cooling period, but doing so has a deleterious effect on resolution and/or mass accuracy.

SUMMARY

Briefly described, a method for mass spectrometry in accordance with illustrative embodiments of the invention utilizes an ion interface device positioned between an ion trap and a mass analyzer. The ion interface device has a plurality of sequentially arranged confinement cells having spatially fixed locations. The ion trap ejects a first group of ions into a first confinement cell. The first ion group is transported through the ion interface device by successive transfers of the ions between adjacent confinement cells. The ions are held within each confinement cell for an associated confinement duration, during which time the ions undergo energetic cooling. Preferably, one of the confinement cells is configured as a collision/reaction cell to cause at least a portion of the ions to dissociate into product ions. Ions in the first group are transferred from a final confinement cell to the entrance of a TOF or other mass analyzer (either directly or via one or more storage devices or ion guides interposed between the ion interface device and the mass analyzer) for acquisition of a mass spectrum. Because the ions are conveyed through the ion interface device in a sequence of transfers between separate confinement cells, multiple ion groups may be concurrently delivered through the ion interface device while still remaining segregated from one another. By matching the maximum confinement cell residence time to the ejection time of the ion trap (i.e., the time needed to scan out a group of ions having a particular m/z window) and by providing a suitable aggregate ion cooling time (determined by the sum of cooling times in the plural confinement cells), the ions are cooled sufficiently to enable the acquisition of mass spectra at high resolution, without having to substantially delay the ejection of a subsequent group of ions from the ion trap until cooling of the previous group is completed.

According to a specific implementation, the ion interface device may be formed from an array of elongated rod electrodes having their major axes oriented transversely to the overall direction of ion movement through the ion interface device. Confinement of groups of ions within individual confinement cells and transfer of ions between cells are achieved by application of suitable radio-frequency (RF) and direct current (DC) voltages to the various electrodes. The ion interface device may be of unitary construction, whereby all of the confinement cells are located within a single assembly, or may alternatively be constructed as two or more separate units.

DETAILED DESCRIPTION OF EMBODIMENTS

Figure 1:
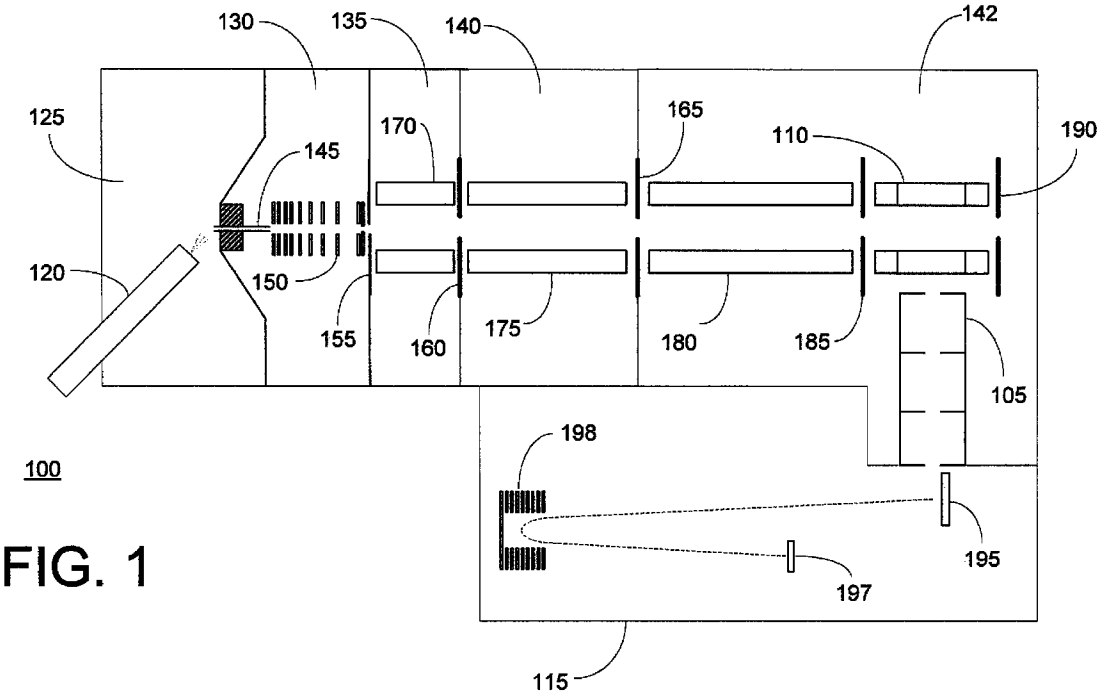
FIG. 1 is a symbolic diagram of a mass spectrometer configured according to an illustrative embodiment of the invention.

FIG. 1 depicts the components of a mass spectrometer 100 which includes an ion interface device 105 for cooling ions ejected from an ion trap 110 and transporting the ions to the inlet of a TOF mass analyzer 115, in accordance with an embodiment of the present invention. It will be understood that certain features and configurations of mass spectrometer 100 are presented by way of illustrative examples, and should not be construed as limiting the ion trap mass analyzer to implementation in a specific environment. An ion source, which may take the form of an electrospray ionization (ESI) source utilizing an ESI probe 120, generates ions from an analyte material, for example the eluate from a liquid chromatograph (not depicted). The ions are transported from ion source chamber 125, which for an ESI source will typically be held at or near atmospheric pressure, through several intermediate chambers 130, 135 and 140 of successively lower pressure, to a vacuum chamber 142 in which ion trap 110 resides. Efficient transport of ions from source chamber 125 to ion trap 110 is achieved by the use of suitable ion optical components, such as ion transfer tube 145, S-lens 150 (the design and operation of which is described in U.S. Pat. Nos. 7,514,673 and 7,781,728 to Senko et al.), electrostatic lenses 155, 160 and 165 and radio-frequency (RF) multipole ion guides 170, 175 and 180. Intermediate chambers 130, 135 and 140 and vacuum chambers 142 and 182 are evacuated by a suitable arrangement of pumps to maintain the pressures therein at the desired values. Ion trap 110 may be provided with axial trapping electrodes 185 and 190 (which may take the form of conventional plate lenses) positioned axially outward from the ion trap RF electrodes to assist in the generation of a potential well for axial confinement of ions, and also to effect controlled gating of ions into the interior volume of ion trap 140. A damping/collision gas inlet (not depicted), coupled to a source of an inert gas such as helium or argon, will typically be provided to controllably add a damping/collision gas to the interior of ion trap 110 in order to facilitate ion trapping, fragmentation and cooling.

Ion interface device 105 is divided into a plurality of separate confinement cells. As will be discussed in greater detail below, ion interface device 105 receives groups of ions ejected from ion trap 110 and transports the ions to an inlet of TOF analyzer 115 via a series of successive transfers between adjacent confinement cells. The ions are held within each confinement cell for an associated confinement duration, during which time the ions undergo energetic cooling. In a preferred embodiment, one of the confinement cells is configured as a collision/reaction cell to cause incoming ions to undergo fragmentation by collision activated dissociation (CAD) or other mechanism of dissociation.

The energetically cooled ions are transferred from a final confinement cell of ion interface device 105 to the inlet of TOF analyzer 115. TOF analyzer may conventionally comprise a pusher electrode 195 which directs ions toward an ion path, along which ions are separated according to their mass-to-charge ratios (m/z's) by virtue of the dependence of ion velocity on m/z. The separated ions are detected at detector 197, which generates signals that are processed to generate a mass spectrum. A reflector 198 may be provided to extend the ion path length, as well as to compensate for variations in the initial kinetic energies of the ions.

The operation of the various components of mass spectrometer 100 is directed by a control and data system (not depicted in FIG. 1), which will typically consist of a combination of general-purpose and specialized processors, application-specific circuitry, and software and firmware instructions. The control and data system also provides data acquisition and post-acquisition data processing services.

While mass spectrometer 100 is depicted as being configured for an electrospray ion source, it should be noted that other implementations may utilize any number of pulsed or continuous ion sources (or combinations thereof), including without limitation a matrix assisted laser desorption/ionization (MALDI) source, an atmospheric pressure chemical ionization (APCI) source, an atmospheric pressure photo-ionization (APPI) source, an electron ionization (EI) source, or a chemical ionization (CI) ion source. Furthermore, while embodiments of the invention are described herein with reference to a TOF mass analyzer, those of ordinary skill will appreciate that the interface device and method described herein may be beneficially utilized in connection with other types of mass analyzers, including but not limited to Orbitrap and other electrostatic trap mass analyzers, Fourier Transform/Ion Cyclotron Resonance (FTICR) mass analyzers, and quadrupole ion trap mass analyzers.

Figure 2:
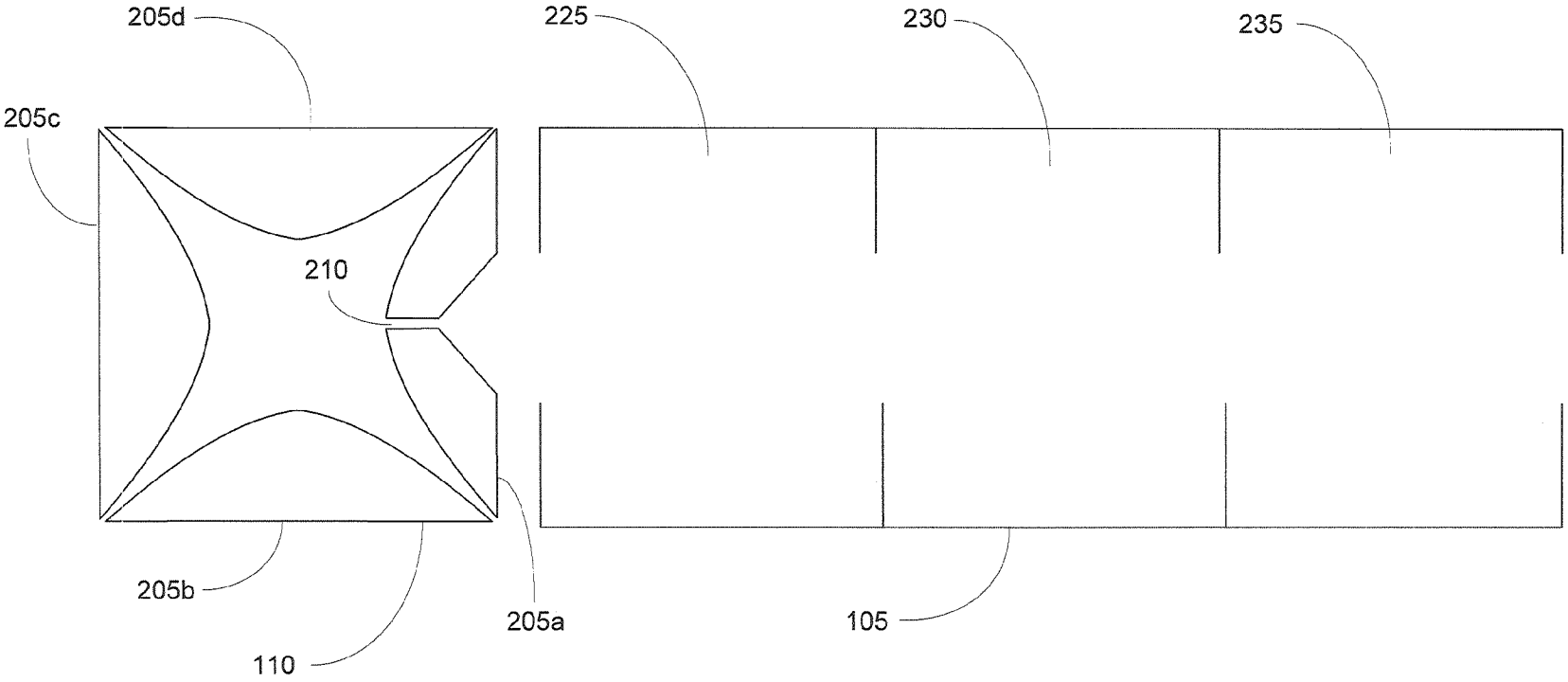
FIG. 2 is a symbolic diagram depicting in greater detail features of the ion interface device of the FIG. 1 mass spectrometer.

FIG. 2 is a symbolic side view of ion interface device 105 and ion trap 110. Ion trap 110 is preferably of the two-dimensional radial ejection type, and includes four axially elongated electrodes 205*a,b,c,d* arranged in mutually parallel relation about a centerline. Each electrode 205*a,b,c,d* has a truncated hyperbolic-shaped surface facing the interior volume of ion trap 110. In a particular implementation, each electrode is segmented into front end, central and back end segments, which are electrically insulated from each other to allow each segment to be maintained at a different DC potential. For example, the DC potentials applied to the front end and back end sections may be raised relative to the DC potential applied to the central sections to create a potential well that axially confines positive ions to the central portion of the interior of ion trap 105. At least one electrode 205*a* is adapted with an axially elongated aperture (slot) 210 that extends through the full thickness of the electrode to allow ions to be ejected therethrough in a direction that is generally orthogonal to the central longitudinal axis of ion trap 110. One or more of the remaining electrodes 205*b,c,d* may be adapted with surface features such as recesses or displaced from the ideal hyperbolic radius $r_0$ in order to minimize undesirable higher-order field components arising from the presence of aperture 210.

Electrodes 205,*a,b,c,d* (or a portion thereof) are coupled to an RF trapping voltage source, excitation voltage source, and DC voltage source (not depicted), all of which communicate with and operate under the control of a controller that forms part of the control and data system. The RF trapping voltage source is configured to apply RF voltages of adjustable amplitude in a prescribed phase relationship to pairs of electrodes 205*a,b,c,d* to generate a trapping field that radially confines ions within the interior of ion trap 110. The DC voltage source is operable to apply DC potentials to electrodes 205*a,b,c,d* or sections thereof to, for example, generate a potential well that axially confines ions within ion trap 110. The excitation voltage source applies an oscillatory excitation voltage of adjustable amplitude and frequency across at least one pair of opposed electrodes to create a dipolar excitation field that resonantly excites ions for the purposes of isolation of selected species, collision induced dissociation, and mass-sequential scanning. During a mass-sequential scan, the RF trapping voltage amplitude is progressively increased from a first value to a second value, which respectively correspond to the lowest and highest m/z ions to be ejected, while a resonant excitation voltage is applied across electrodes 205*a,c*. This causes the ions to become resonantly excited and ejected from ion trap 110 (via aperture 210) in order of their m/z's. For all-mass MS/MS operation, the mass sequential scan is broken into a number of scan periods or windows, during each of which a group of ions within a relatively narrow range of m/z's is ejected to ion transfer device 105. In one illustrative example, a mass sequential scan representing a total interval (difference between lightest and heaviest ions ejected) of 600 Th may be broken into 100 component scan windows, each representing an m/z range of 6 Th. For a typical mass-sequential scan rate of 16,000 Th/s, each scan window requires 6/16,000=375 μs to complete. Since this time is significantly shorter than the time required for fragmentation and cooling (at typical operating pressures) of the ejected ions prior to analysis in a TOF mass analyzer, delaying the ejection of a group of ions until the previously ejected group is fully cooled and fragmented would substantially increase the total analysis cycle time and reduce throughput. The utilization of ion interface device 105 avoids the need to delay ejection of a group of ions pending completion of cooling and fragmentation of a previous group, as described below.

Although not depicted in FIG. 2, an electrostatic gate lens or other suitable ion optic may be positioned between the ion trap ejection aperture 210 and the entrance to ion interface device 105. This gate lens or other ion optic is operable to selectively allow or exclude the entry of ions ejected from ion trap 110 into ion interface device 105. For example, the gate lens may be operated to block entry (e.g., by applying a suitable potential to the gate lens electrode) into ion interface device 105 while a previously ejected group of ions are being transferred between the first and second confinement cells, and to allow entry of a subsequent group of ions after the transfer of the previously ejected group has been completed.

The design and operation of the ion trap described above is presented only by way of example, and should not be construed as limiting the scope of the invention. Other ion trap configurations (including two-dimensional quadrupole ion traps adapted for mass-selective axial ejection of ions through a barrier field, an example of which is described in U.S. Pat. No. 6,177,668 to Hager) may be used in place of the radial-ejection two-dimension ion trap disclosed above and depicted in the drawings.

Generally described, ion interface device 105 consists of a plurality of confinement cells (alternatively referred to as confinement, trapping or cooling regions) arranged next to each other, such that ion groups may be transferred rapidly between adjacent confinement cells. Although the figures depict ion interface device as being divided into three distinct confinement cells 225, 230 and 235, other implementations of the invention may utilize an ion interface device having only two confinement cells, or more than three confinement cells. Confinement cells 225, 230 and 235 may be filled with a neutral collision/damping gas, such as argon, to induce fragmentation (which results from the collisions of energetic ions with atoms or molecules of the collision/damping gas, causing transfer of kinetic energy to excited vibrational modes of the ions). Concurrently, collisions remove kinetic energy from the incoming ions and product ions derived therefrom. If fragmentation of the incoming ions is desired, the conditions at which ions are resonantly ejected from ion trap 110, the DC potentials applied to electrodes of ion trap 110 and interface device 105 (as well as any intermediate lenses or other ion optics) and the composition of the collision/damping gas are selected such that the kinetic energies of the ions are sufficiently high to cause a substantial portion of the ions to undergo collisionally activated dissociation and produce product ions. In alternative implementations, product ions may be formed by filling transport/collision section 210 with reagent ions or molecules that react with sample ions in the ion packet. Typical collision/damping gas pressures within confinement cells 225, 230 and 235 will be in the range of 1-1.5 mTorr. In certain implementations of ion interface device, it may be desirable to maintain at least two of the confinement cells at different pressures during operation of the mass spectrometer. This pressure differential may be achieved, for example, by providing conductance limited apertures in partitions between adjacent confinement cells and/or by adding collision/damping gas to selected confinement cells.

Confinement of ions within a confinement cell may be achieved by the combined action of oscillatory (e.g., radio-frequency) and static fields effected by the application of RF and DC voltages to electrodes of ion interface device 105. When transfer of ions is desired, certain applied voltages are adjusted or removed in order to eliminate potential barriers between adjacent confinement regions and allow or urge the movement of ions to the next confinement cell. Once the transfer is completed, the confinement fields are re-established by again adjusting or removing at least a portion of the applied voltages. Specific examples of the construction of ion interface device 105 and the confinement/transfer operations are presented below in connection with FIGS. 3A-3G and FIG. 4. It should be noted that the confinement cells of ion interface device 105 have spatially fixed locations, in contrast to the apparatus described in U.S. Pat. No. 6,794,641 to Bateman et al., in which trapping regions established in a stacked ring ion guide are translated along the length of the ion guide.

FIGS. 3A-3G illustrate the movement of groups of ions into and through ion interface device 105 at successive time-points, with time increasing from top to bottom. In the initial step (depicted in FIG. 3A and indicated by the arrow labeled "A"), a first group of ions (labeled "1"), which may represent ions within a narrow range of m/z's, is ejected from ion trap 110 and is accumulated and confined within a first confinement cell 225 during an corresponding confinement period, designated $t_1$. Preferably $t_1$ will be matched to (be approximately equal to or less than) the scan window period, i.e., the time required to scan out a group of ions within the narrow specified m/z range. In the example discussed above the confinement period would be set approximately equal to the scan window period of 375 μs required to scan out ions having an m/z range of 6 Th. As noted above, the occurrence and degree of fragmentation may be controlled by adjusting the kinetic energies of the ions admitted to first confinement cell 225, for example by tuning the DC offsets applied between electrodes of ion trap 110 and first confinement cell 225 and/or ion optics (e.g., lenses) located therebetween. During the confinement period, the ions of the first group (for purposes of clarity, the term "ion group" and its variants denote those ions ejected during a particular scan window period, as well as the product ions formed by fragmentation/reaction of the ejected ions) are thermally cooled by means of collisions with the damping gas, such that the kinetic energies and kinetic energy spread of the ions are reduced.

Figure 3A:
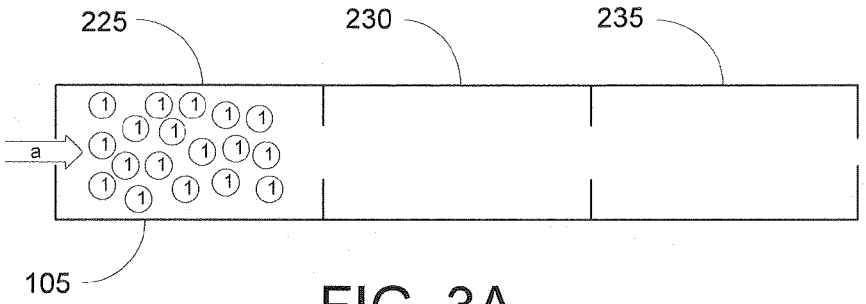
FIGS. 3A-3G represent a time series of symbolic diagrams illustrating the flow of groups of ions through the ion interface device.
Figure 3B:
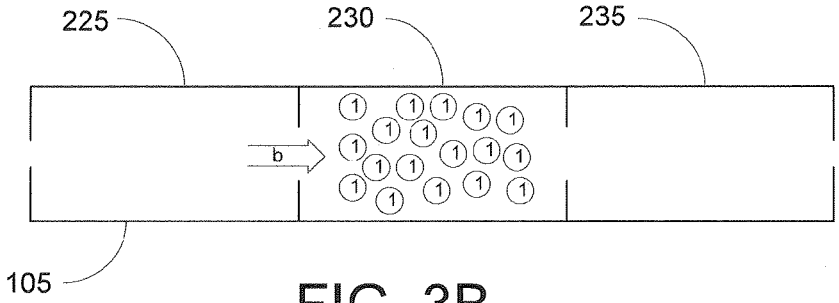

After completion of the confinement period in first confinement cell 225, the ions of the first group are transferred to adjacent second confinement cell 230, as indicated by the arrow marked "B" in FIG. 3B. Transfer of ions between adjacent confinement cells 225, 230 may be accomplished by changing or removing DC voltages applied to one or more electrodes of the ion interface device structure, such that the potential barrier between the adjacent cells is removed. An axial field may also be established to urge ions in the direction of second confinement cell 230. Once transfer of all ions of the first group is completed, a potential barrier is re-established between first and second confinement cells 225 and 230 to inhibit the movement of ions therebetween. The transfer step is completed as quickly as possible, and optimally on a time scale significantly shorter than the scan window period (e.g., between 4 and 12 μs at 1.5 mTorr damping gas pressure, depending on the masses of the transferred ions) in order to avoid the need to delay ejection from ion trap 110 of the next ion group.

Figure 3C:
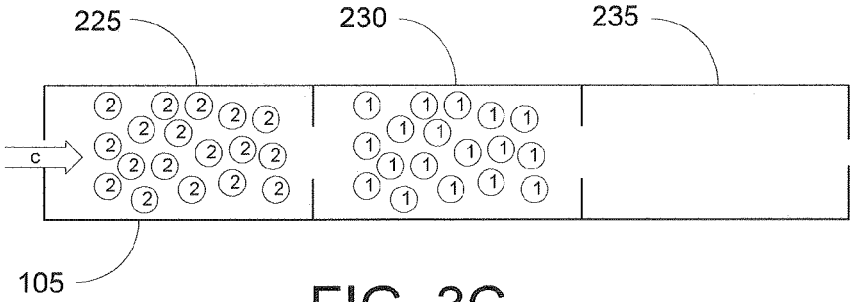

As shown in FIG. 3C, after the first group of ions have been transferred to second confinement cell 230 and the potential barrier has been re-established, a second group of ions, marked "2" (which may represent ions having incrementally higher values of m/z relative to the first group) is ejected from trap 110 and accumulated in the first confinement cell 225, where they experience fragmentation and cooling, as described above in connection with the first ion group. As the second ion group is accumulated, fragmented and cooled in first confinement cell 225, the first ion group undergoes additional cooling in second confinement cell 230 to further reduce kinetic energies and kinetic energy spread. The confinement period $t_2$ of ions within second confinement cell 230 may be set approximately equal to the confinement period $t_1$ within first confinement cell 225, for example around 375 μs. Alternatively, $t_2$ may be set at a value less than $t_1$, such that the confinement of ions held within second confinement cell 225 is completed and the ions are transferred into third confinement cell 235 while ions are still being cooled in first confinement cell 225.

Figure 3D:
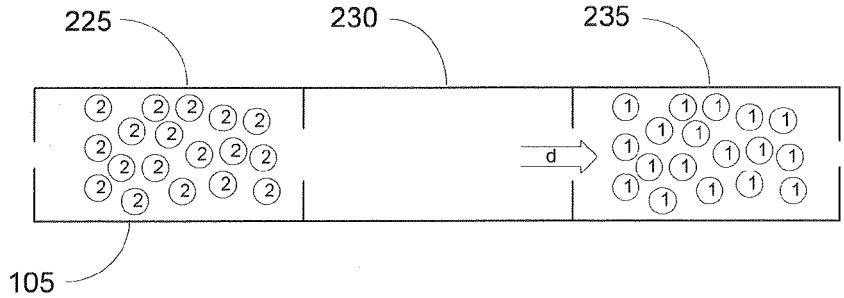
Figure 3E:
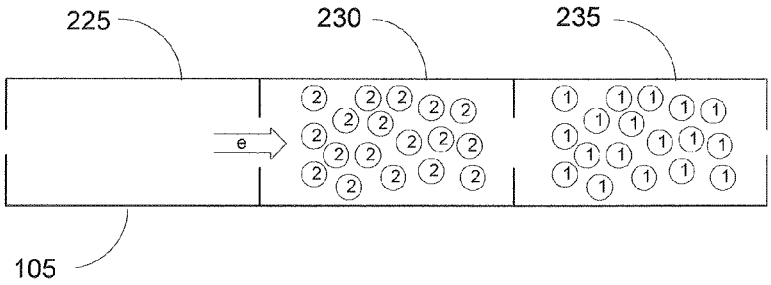
Figure 3F:
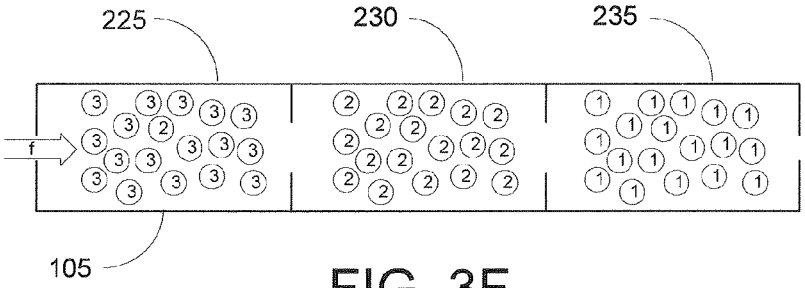

After completion of confinement of the first group of ions in second confinement cell 230, the ions are transferred to third confinement cell 235, as indicated by the arrow marked "D" in FIG. 3D. Transfer of the ions may be effected in the same manner described above with respect to the transfer of ions from first confinement cell 225 to second confinement cell 230. When the confinement period in first confinement cell $t_1$ 225 ends (which confinement period, as discussed above, may be roughly the same or longer than the confinement period within second confinement cell 230), the second group of ions are transferred into second confinement cell 230) for additional cooling, as indicated by arrow marked "E" in FIG. 3E. Again, it is desirable to perform the transfers as quickly as possible, and more particularly on a time scale that is short compared to the scan-out window period.

Following transfer of the first and second groups of ions, a third group of ions, marked "3" (which may represent ions having incrementally higher values of m/z relative to the second group) is ejected from trap 110 and accumulated in the first confinement cell 225, where they experience fragmentation and cooling, as described above in connection with the first and second ion groups. This step is represented by the arrow marked "F" in FIG. 3F. As the third ion group is accumulated, fragmented and cooled in first confinement cell 225, the first and second ion groups experience additional cooling in (respectively) third confinement cell 235 and second confinement cell 230 to further reduce kinetic energies and kinetic energy spread. The confinement period $t_3$ of ions within third confinement cell 230 may be set substantially equal to, or less than, the confinement period $t_2$ within second confinement cell 230.

Figure 3G:
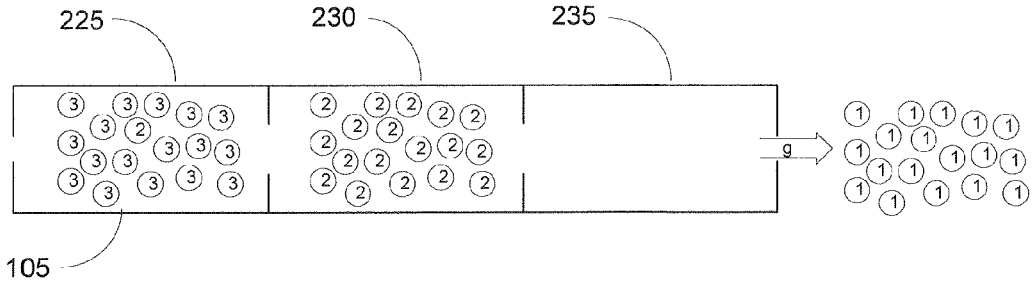

In the step depicted in FIG. 3G, the first group of ions is removed from third confinement cell 235 to the inlet of TOF analyzer 115 for mass analysis, as indicated by the arrow marked "G". In certain implementations, the ions may be removed to TOF analyzer in a series of pulses (each pulse comprising a portion of the total ion population), with each pulse being separately mass analyzed. The multiple mass spectra thus acquired may be averaged to achieve a greater signal-to-noise ratio, in a manner well-known in the mass spectrometry art.

It should be recognized that the invention should not be construed as being limited to embodiments whereby ions are ejected directly from the final confinement cell of ion interface device 105 to the entrance of the TOF or other mass analyzer. Other embodiments may include any one or number of intermediate devices (for example, an ion storage device or ion guide) located in the ion path between ion interface device 105 and the mass analyzer. In one particular implementation, an ion distributor is disposed between the ion interface device and the mass analyzer. The ion distributor controllably directs ions on a selected one of a plurality of ion paths, at least one which leads to the mass analyzer. The mass analyzer may also include a plurality of mass analyzers, such as an array of quadrupole ion traps, and the ion distributor is operated to direct a group of ions to a particular one of the mass analyzers. A variety of structures known in the art, for example a deflection electrode to which a suitable potential is dynamically applied, may be utilized as an ion distributor. According to another example, the ion distributor may include a plurality of distribution/confinement cells, similar to the device described in U.S. patent application Ser. No. 13/287,849 filed Nov. 2, 2011 by the present inventor, the entire disclosure of which is incorporated herein by reference.

It will be recognized that each transfer of ion packets within ion interface is not instantaneous, but instead will require a finite time to complete. However, the applicant has found (via detailed computer modeling of ion motion during transfer operations), that the aggregate transfer time is significantly shorter than the confinement period required for adequate energetic cooling, and will typically comprise about ten percent of the total residence time within interface device 105.

Ions transported through ion interface device in the manner described above experience an aggregate post-ejection confinement period of $t_1+t_2+t_3$. In the above example, assuming that ions are confined in each confinement cell 225, 230 and 235 for a period of 375 μs and the confinement cells are held at a pressure of about 1.5 mTorr, the aggregate ion confinement period is 1125 μs, and the product of pressure and confinement time is 1.69 ms·mTorr. The aggregate confinement period should be of adequate duration to reduce the ions' kinetic energies to values that permit acquisition of a mass spectrum at high resolution and mass accuracy. As set forth in the background section, the amount of ion cooling will be a function of the product of confinement cell pressure and confinement period. In exemplary implementations, ion interface device is operated to provide a product of confinement cell pressure and confinement period of at least 1 ms·mTorr, and more preferably in the range of 2-5 ms·mTorr. It is noted that the simplified analysis presented above assumes that the transfer of ions between adjacent cells is implemented without significantly raising the kinetic energies of the transferred ions, which would require the use of relatively low longitudinal DC fields and longer transfer times; if the ion interface device is operated such that the kinetic energies are significantly increased during inter-cell transfer, then the requisite confinement periods would need to be adjusted accordingly. It will be apparent that the aggregate confinement period may be increased (without delaying the operation of the ion trap) by providing a relatively greater number of successively arranged confinement cells; greater degrees of energetic cooling may also be achieved by increasing the pressure of collision/damping gas within the confinement cells.

As described above, the design of interface device 105, in particular the provision of a plurality of separate confinement cells, enables the concurrent transport and cooling of two or more successively ejected ion groups. As used herein, the term "concurrent" and its variants are intended to denote two or more events, or sequences of events, that overlap in duration. The two events or sequences of events do not need to be exactly coextensive in time to be concurrent. Otherwise expressed, two events or sequences of events are considered to be concurrent or to occur concurrently if one begins before the other terminates. For example, as described above, ion interface device 105 may be operated to block entry of an ejected group of ions until transfer of a previously ejected ion group from the first to second confinement cells has been completed. In this example, the transport of the first group of ions through the ion interface should be considered to be concurrent with the ejection and transport of the second group of ions, since the residence periods of the two ion groups within ion interface device 110 overlap.

The steps described above are repeated for ion groups successively ejected from ion trap 110. This sequence is repeated until the analytical scanning of the ion trap is terminated (or until another specified termination point has been reached), and all ion packets have been mass analyzed in TOF mass analyzer 115.

Figure 4:
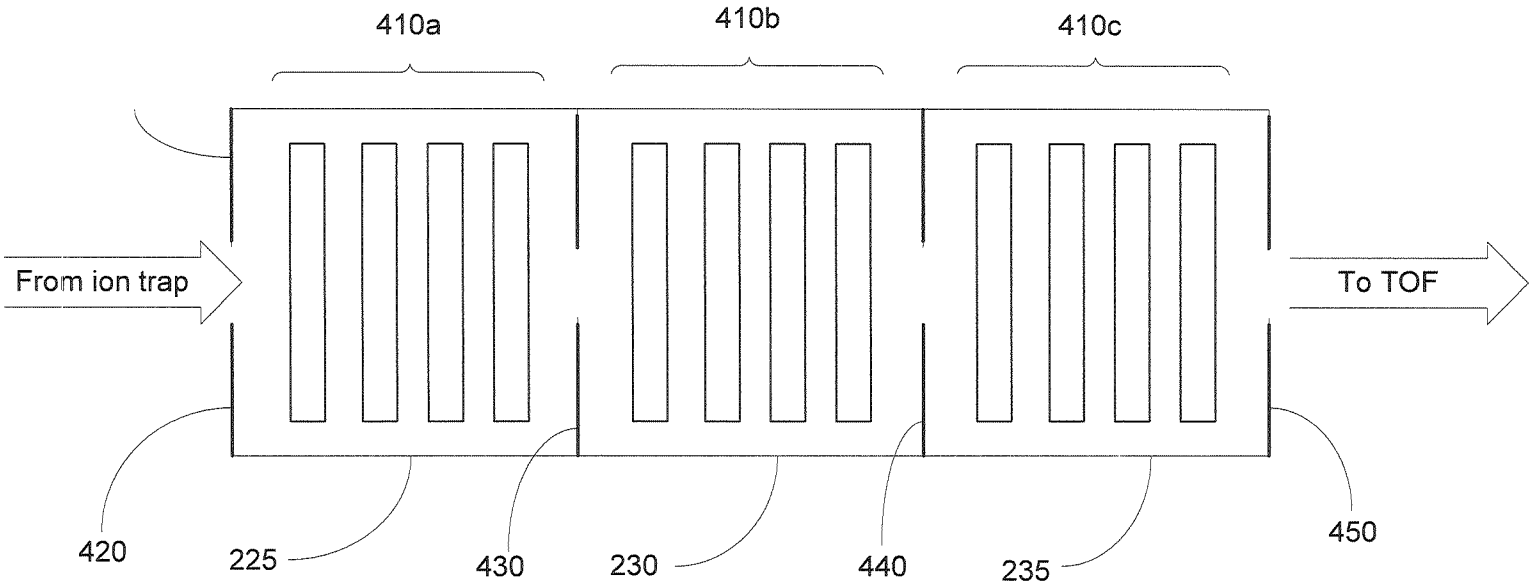
FIG. 4 is a symbolic diagram depicting a particular construction of the ion interface device constructed in accordance with an alternative embodiment.

FIG. 4 depicts a particular implementation of the ion interface device 105 shown in FIG. 2. The ion interface device comprises sets of elongated rod electrodes, arranged in two parallel planes (one of which is shown in the figure, with the second lying above or below the depicted plane) and positioned within an enclosure. Each confinement cell 225, 230 and 235 is provided with corresponding rod electrodes 410*a, b,c* oriented transversely to the major longitudinal axis of interface device 105 (along which ions are injected and travel) and positioned in spaced apart relationship along the major axis. An RF source (not depicted) applies RF potentials in a prescribed phase relationship to electrodes, whereby each electrode 410*a,b,c* receives an RF potential that is 180 degrees out of phase with respect to the adjacent and opposing (across the plane normal to the drawing) electrodes. This establishes an RF field to radially confine ions traveling along the longitudinal axis.

Confinement of an ion group within a specific confinement cell may be effected applying suitable DC potentials (supplied from a not-depicted DC source) to one or more of the rod electrodes 410*a,b,c* and/or to electrostatic lenses 420, 430,440 and 450 to create longitudinal potential wells that inhibit ion movement between adjacent confinement cells. Transfer of ions between cells is achieved by changing the applied DC voltages to remove the potential wells. In some implementations of ion interface device 105, it may be desirable to also generate longitudinal DC fields (also referred to as drag fields) of controllable direction and magnitude to urge or retard the longitudinal movement of ions within a confinement cell. For example, it may be beneficial to generate a longitudinal DC field within first confinement cell 225 in order to first decelerate and confine ions in the region where they undergo fragmentation, and thereafter transfer ions into second confinement cell 230. Longitudinal DC fields of this general description may be created by applying different DC voltages to rod electrodes within a confinement cell, or to auxiliary electrodes (not depicted) positioned around or between the rod electrodes.

Gas may controllably supplied from an external source to the interior of ion interface device 105 (or to an adjacent region in fluid communication therewith) through a suitable conduit arrangement. The gas, which will typically comprise an inert gas such as argon, removes kinetic energy from the incoming ions via collisions and induces (if desired) collisionally activated dissociation. Ion interface device 105 is located in one or more vacuum chambers that are evacuated by means of a suitable pump.

While FIG. 4 depicts ion interface device 105 as having an integral construction, other implementations of ion interface device 105 may be configured as two or more separate structures; for example, the first confinement cell may formed as one unit and the remaining confinement cells formed as a separate unit.

It is to be understood that while the invention has been described in conjunction with the detailed description thereof, the foregoing description is intended to illustrate and not limit the scope of the invention, which is defined by the scope of the appended claims. Other aspects, advantages, and modifications are within the scope of the following claims.

What is claimed is:

1. A method of mass spectrometric analysis, comprising:

providing an ion interface device partitioned into a plurality of sequentially arranged confinement cells having spatially-fixed locations;

accumulating ions within an ion trap;

ejecting a first group of ions of the accumulated ions from the ion trap into a first confinement cell of the plurality of confinement cells;

fragmenting at least a portion of the first group of ions within the ion interface device;

transporting the first group of ions through the ion interface device by successive transfers between adjacent confinement cells, wherein the first group of ions are confined within each confinement cell for a corresponding confinement period;

transferring the first group of ions from a final confinement cell of the ion interface device to an entrance of a mass analyzer;

mass analyzing the first group of ions; and concurrently with transporting the first group of ions through the ion interface device, ejecting a second group of ions of the accumulated ions from the ion trap into the first confinement cell and transporting the second group of ions separately from the first group of ions.

2. The method of claim 1, wherein the second group of ions has a mass-to-charge window different from a mass-to-charge window of the first group of ions.

3. The method of claim 1, wherein the maximum confinement period of ions within a confinement cell of the ion interface device is less than or equal to a scan window duration for ejecting a group of ions within a specified mass window from the ion trap.

4. The method of claim 1, wherein the product of the aggregate confinement period and a pressure within the confinement cells is at least 1 ms·mTorr.

5. The method of claim 1, wherein the product of the aggregate confinement period and a pressure within the confinement cells is in the range of 2-5 ms·mTorr.

6. The method of claim 1, wherein the plurality of confinement cells includes at least three confinement cells.

7. The method of claim 1, wherein the mass analyzer is a time-of-flight (TOF) mass analyzer.

8. The method of claim 1, wherein ions are caused to fragment in the first confinement region.

9. The method of claim 1, wherein ions are caused to fragment in a second or subsequent confinement region.

10. The method of claim 1, wherein ions are confined in each confinement cell for the same confinement period.

11. The method of claim 1, wherein the confinement period in the first confinement cell is different from the confinement period in at least one other confinement cell.

12. The method of claim 1, wherein at least one confinement cell is maintained at a first pressure different from a second pressure at which at least one other confinement cell is maintained.

13. The method of claim 1, wherein the first group of ions is transferred directly from the final confinement cell to entrance of the mass analyzer.

14. The method of claim 1, wherein the first group of ions is transferred from the final confinement cell to the entrance of the mass analyzer through a storage device.

15. The method of claim 14, wherein:

the mass analyzer includes a plurality of mass analyzers; and the step of transferring the first group of ions from the final confinement cell includes directing the ions to a selected one of the plurality of mass analyzers.

16. The method of claim 15, wherein the plurality of mass analyzers comprises an array of quadrupole ion traps.

17. A mass spectrometer, comprising:

an ion trap for accumulating and ejecting ions;

an ion interface device partitioned into a plurality of sequentially arranged confinement cells having spatially-fixed locations, a first confinement cell of the ion interface device being positioned to receive groups of ions ejected from the ion trap;

a controller, coupled to the ion interface device, for causing voltages to be applied to electrodes of the ion trap such that each group of ions is transported through the ion interface device from the first confinement cell to a final confinement cell by a series of transfers between adjacent confinement cells; and a mass analyzer having an entrance positioned to receive ions transferred from the final confinement cell.

18. The mass spectrometer of claim 17, wherein the ion trap includes a two-dimensional ion trap configured to eject ions in a direction orthogonal to the central longitudinal axis of the ion trap.

19. The mass spectrometer of claim 17, wherein the mass analyzer comprises a time-of-flight (TOF) mass analyzer.

20. The mass spectrometer of claim 17, wherein the plurality of confinement cells includes at least three confinement cells.

21. The mass spectrometer of claim 17, wherein the controller is configured to cause ions entering one of the confinement cells to be maintained at velocities sufficient to dissociate a substantial portion of the ions by collisionally activated dissociation.

22. The mass spectrometer of claim 17, wherein the mass analyzer has an entrance positioned adjacent to the final confinement cell such that each group of ions is transferred directly from the final confinement cell to the mass analyzer.

23. The mass spectrometer of claim 17, wherein the mass analyzer comprises a plurality of mass analyzers, and further comprising an ion distributor configured to direct the group of ions from the final confinement cell to a selected one of the plurality of mass analyzers.

24. The mass spectrometer of claim 23, wherein the plurality of mass analyzers includes an array of quadrupole ion traps.

* * * * *